US008365312B2

(12) United States Patent
Herring

(10) Patent No.: US 8,365,312 B2
(45) Date of Patent: Feb. 5, 2013

(54) FORM FITTING VEST FOR CARRYING ARMOR PLATES AND BALLISTIC PANELS

(76) Inventor: Steven Jay Herring, Virginia Beach, VA (US)

( * ) Notice: Subject to any disclaimer, the term of this patent is extended or adjusted under 35 U.S.C. 154(b) by 1178 days.

(21) Appl. No.: 12/211,048

(22) Filed: Sep. 15, 2008

(65) Prior Publication Data

US 2012/0180205 A1 Jul. 19, 2012

Related U.S. Application Data

(60) Provisional application No. 60/973,048, filed on Sep. 17, 2007.

(51) Int. Cl.
*F41H 1/02* (2006.01)

(52) U.S. Cl. ..... 2/2.5; 2/102

(58) Field of Classification Search ..... 2/2.5, 92, 2/94, 102, 456, 462, 463, 465, 467
See application file for complete search history.

(56) References Cited

U.S. PATENT DOCUMENTS 3,557,384 A 1/1971 Barron et al.
3,973,275 A * 8/1976 Blauer ..... 2/2.5
4,507,802 A 4/1985 Small
5,073,985 A 12/1991 Stone et al.
5,325,538 A 7/1994 Schoenweiss et al.
5,495,621 A 3/1996 Kibbee
5,617,582 A * 4/1997 Burwell ..... 2/102
6,185,738 B1 2/2001 Sidebottom
6,625,814 B1 9/2003 Veh

* cited by examiner

*Primary Examiner* — Katherine Moran
(74) *Attorney, Agent, or Firm* — Berenato & White, LLC

(57) ABSTRACT

Vest panels are constructed with outwardly exposed Velcro material (hook and loop) panels and 1" interval sewn webbing to create an attachment system (MOLLE) that allows items to be attached to the outside of the front and back piece plate holders. The closure flap holding the hard armor plate inserts are lined with "SPECTRA" ballistic fabric which resists wearing on the flap from the inside, making it more secure. Hook and loop fastening is used to secure the top and bottom of the armor plate insert flap assembly for secure closure. The front and back sections of the vest are attached one to the other at the shoulder with adjustable straps using hook and loop overlapped lengths to form a "clam shell" unit. Protective soft gear is placed in the inwardly oriented mesh pocket of the vest, and armor plate is placed in the outside pocket. Front and back sections are further secured one to the other with a "side plate holding" system which is constructed to hold a side armor plate as well as to secure the front and back sections to the user with hook and loop material connected with elastic webbing elements to provide for resilient but comfortable movement of the wearer.

5 Claims, 6 Drawing Sheets

FORM FITTING VEST FOR CARRYING ARMOR PLATES AND BALLISTIC PANELS

This application claims the benefit of Provisional Application No. 60/973,048, filed Sep. 17, 2007.

BACKGROUND OF THE INVENTION

1. Field of the Invention

The invention relates generally to a vest for carrying armor plates and ballistic panels. Specifically, this invention relates to a light weight multi-layered vest garment with internally and externally accessible pockets for carrying and retaining armor plate and ballistic panels. The vest is adjustable to be form fitting allowing users to experience greater mobility and ease of wearing features.

2. Background

Personally worn armor plate and ballistic panels have become common place for special purpose police assignments, i.e., SWAT Teams, ATF, and also on the battlefield for soldiers of all types. While effective in their role of offering protection, currently available vest garments for carrying armor and ballistic panels are heavy and cumbersome to use. Most vests on the market are made with two to three times the mass of material, as compared to the vest described herein, in addition they have heavy zippers and release methods that are slow or unable to operate smoothly. Many units use a heavy plastic-coated metal cable to hold portions of the vest in place, as a rapid release option, which often times becomes bound up and unable to operate smoothly. Many other vests use a wrap around waist securing system, using cord and metal cable to attach to the unit, all of which is heavy and restricts the ability of the user to operate smoothly and without excessive chafing over time.

SUMMARY OF THE INVENTION

The present invention advantageously fills the aforementioned deficiencies by providing light weight form fitting vest for carrying armor plates and ballistic panels.

The vest of the present invention is designed using lightweight materials which provide for far less weight than existing units. The vest provides greater flexibility and adjustability. The clam shell design ensures a complete wrap of protective protection from the range of current armor/ballistic panels being used. The vest can be easily adjusted and made to conform to the wearer's body for comfort. A side plate holding system allows the use of additional armor plates for protection with the same comfort for the user. The outer plate design allows the extraction of the hard armor from the vest with ease and allows the wearer to maintain the use of underlying soft armor for more casual protection. In addition, owing to the ability of the vest to be conformed to the body shape, it allows longer use time with less fatigue for the wearer. The vest can be used with ballistic material; float panels and or hard plates with the same body contouring effect for longer wear with less fatigue. The panel sections of the vest allow for the replacement of front or back sections as well as replacement of side plate holders if damaged, thus providing a cost effective replacement system not currently in use by other "all or nothing" use and replace units.

The lightweight design of the vest allows the wearer greater mobility in use in a combat or protective operation. The inside mesh material ensures greater ventilation and body cooling when being worn. The vest can be quickly removed with a single motion allowing the wearer to exit the vest rapidly when required. The edge contacting materials used to retain the hard plate are ballistic in nature which adds additional strength and hardiness to the construction during operations use. The shoulder attachment system is designed to eliminate the use of rigid hardware elements (clips, snaps, mechanical hooks and clasps) that can become painful during long duration of use.

The vest can be worn with both soft armor and hard plates. Alternatively, it may be worn without hard armor and only soft armor or with hard armor and no soft armor. It may be worn with flotation foam and either soft armor or hard armor or both to provide an ability to maintain a float status until retrieved. In addition, the use of Velcro (hook and loop) material provides a securing ability for communication devices.

The vest of the present invention is lighter in weight and allows more flexibility. It has eliminated hard point attachment systems, allowing the unit to be lower in profile. Use of commercial hook and loop material along with ballistic material on the plate carrier ensure longer life and safer use.

The overall clam shell design allows for ease of removal as well as ease of use. The attachment straps used with the commercial hook and loop material provide very high strength as well as the ability to replace if needed without replacing the entire unit. The ballistic edge lining material on the hard plate assembly containment pocketing is far superior to existing material and extends the life of the unit while in use. The detachable side plate holders make for easy adjustment and can be replaced if damaged without replacement of the entire unit. The mesh backing on all sections allows for reduction of body heat and for superior drainage when wet. The design allows for multiple types of soft gear material to be utilized by the user, for example, ballistic soft panels, float foam and/or a combination thereof. The design also makes the vest a multi-use item which is easy to replace or repair damaged sections.

Finally, it is an object of the present invention to provide a vest for carrying armor plates and ballistic panels that does not suffer from any of the problems or deficiencies associated with prior solutions.

The present invention will now be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
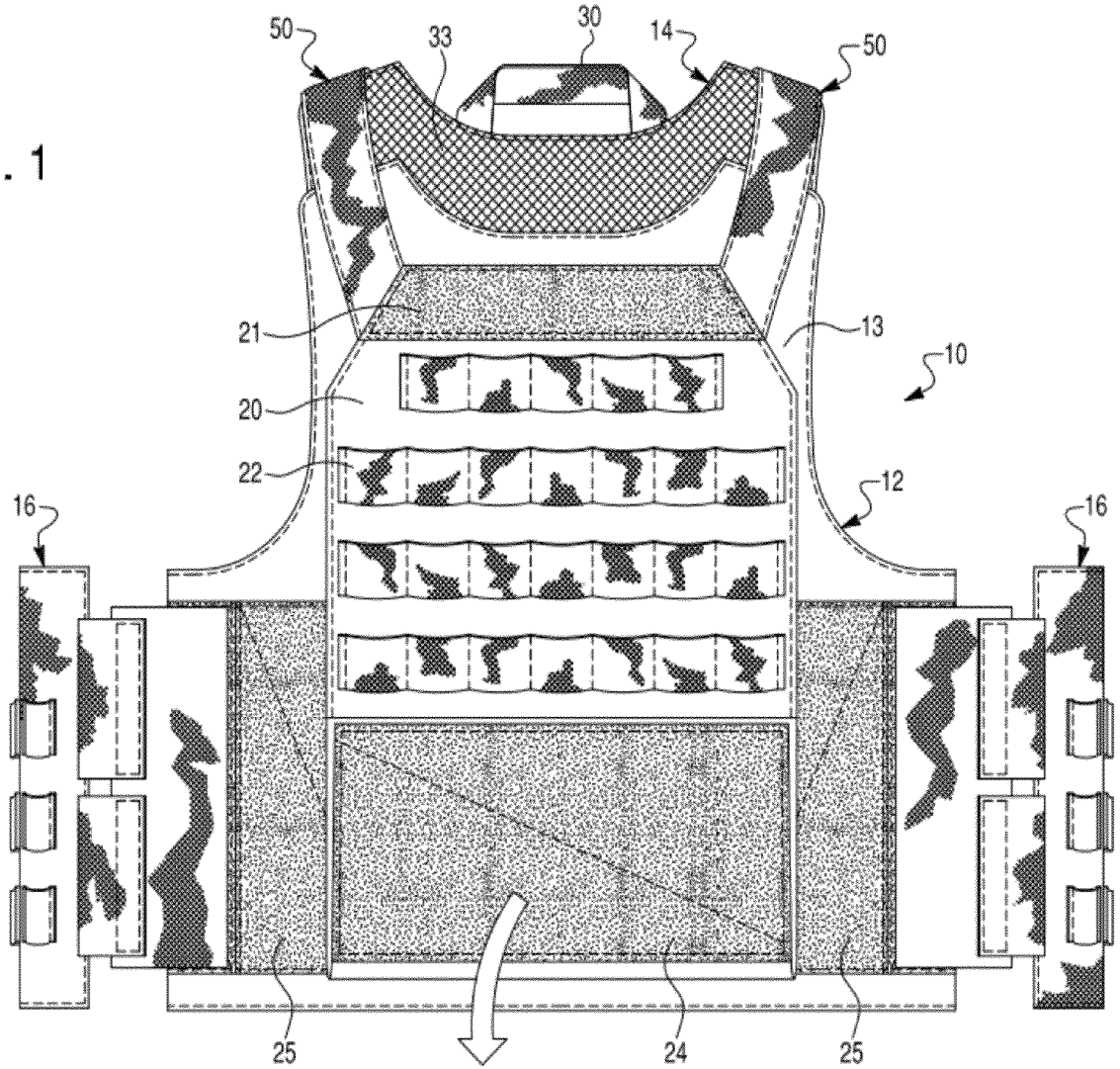
FIG. 1 is a front view of an assembled vest according to the present invention.

With reference to the drawing figures: Generally, the vest 10 contains linked front 12 and back 14 panels that each include an inner soft armor holding system and an outer hard plate holding system. The front 12 and back 14 panels are linked at the shoulder using webbing 50 and Velcro material to secure the respective panels and allow for adjustability. The shoulder straps 50 may contain "D" rings for attachment of equipment as needed. The shoulder straps use an industrial hook and loop system for attachment for high strength. The outside panels have a 1" MOLLE (front 20, rear 36) system (1" webbing, sewn, across the webbing at 1.5" intervals along its length, to an underlying fabric surface) which provides for the attachment of additional gear using familiar MOLLE standards 22 as required. The side elements 16 are designed to be able to carry hard plate protection as well as molle 46 on the outside for additional equipment attachment. The inner fabric panels of front 12 and back panels 14 as well as the side plate holders are constructed with a high tenancy mesh material (front 23, rear 33, side 43) which provides superior venting of body heat and rapid drying of the unit after use. The outwardly exposed fabric of the respective front, back, and side plate carrying elements is preferably made of 1000 denier high strength material (for example, cordora) for sturdy construction. All edge sewing is preferably 5 stitch per inch for strength.

Figure 2:
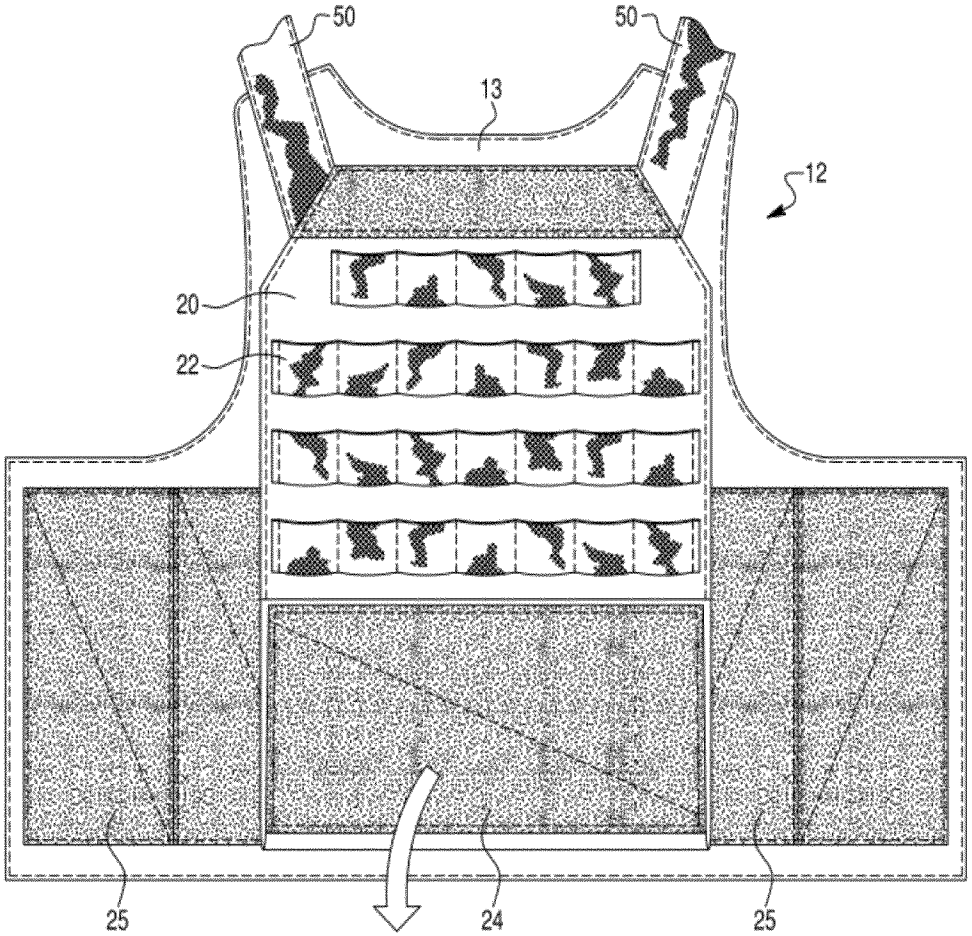
FIG. 2 is a front view of the front piece of a vest according to the present invention.

In FIG. 1 an assembled vest 10 is shown. The front panel 12 is linked through 2 inch width shoulder straps 50 and side elements 16 to a complementary back panel 14. The respective front and back panels share generally similar overall construction features. Each outward surface of the respective panels is equipped with a MOLLE (Modular Lightweight Load-carrying Equipment) style attachment system 20 equipped with MOLLE standards 22. The material layer 13 underlying the MOLLE panel forms the intermediate vest layer and backing element of a hard armor pocket underlying substantially the entirety of the front panel 12 of the vest. Such hard armor element inserts are available in standard sizes and capabilities and are individually inserted into the holding pocket. Direct access to the hard armor plate pocket is provided through hook and loop covered downwardly opening pocket closure 24 on the front panel 12. This feature enables quick removal and replacement of hard armor panels from within the pocket. The inner surface of the hard armor pocket closure, that maintains rubbing contact with an inserted element of hard armor, is selectively lined with "SPECTRA" ballistic material at high wear locations to resist chafing wear-through at the pocket closure. The SPECTRA ballistic fabric currently used is characterized as SPECTRA 650 Denier SPECTRA 1200 Denier. These fabrics exhibit extreme wear-through resistance owing to the high performance thread and weave combinations and coatings. Other, similar fabrics, would also likely be suitable if they exhibit similar performance characteristics. As shown in both FIGS. 1 and 2, virtually the entire lower front portion of the front panel 12 is covered in 4 inch width hook and loop closure fabric overlying the pocket closure 24 and on the side elements attachment portions 25 and (a somewhat narrower hook and loop patch) on an upper breast element 21. As will be discussed, this large amount of hook and loop closure fabric used throughout provides a greater range of fitment features when used in conjunction with the hook and loop fastening side elements 16.

Figure 3:
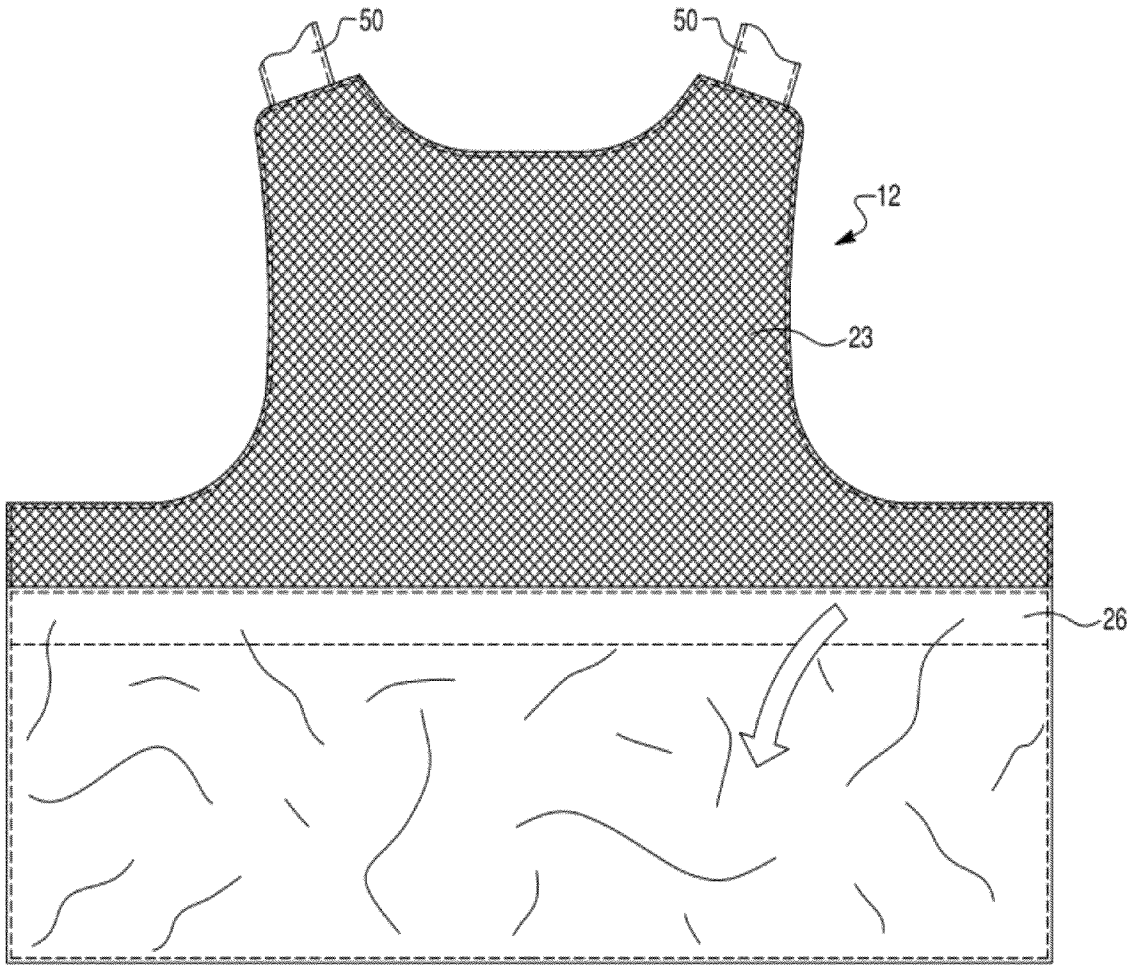
FIG. 3 is a forward looking view of the inside of the front piece of the vest in accord with the present invention.

FIG. 3 shows the inner mesh panels of the front vest panel 12. The inner liner is a high tenacity mesh 23. The mesh 23 forms a full panel sized pocket against the front panel backing fabric 13. The respective 3 layers of fabric creating the layers of the vest panels (outer 20, intermediate 13, and inner 23) are sewn or otherwise attached (i.e., heat sealed) around a periphery thereof to form the respective inner and outer armor element containing pockets. The inner pocket is accessed through hook and loop closure 26 that allows placement of full panel shaped "soft armor". The soft armor, when in place in the inner pocket of the front panel 12, rests against the wearer through mesh panel 23. The soft armor and mesh relieve direct contact from a hard armor plate contained in the outer pocket of the front panel 12 and accessed through closure 24. Straps 50 are relatively wide webbing using hook and loop overlapping closure to secure the front panel in a comfortable location over the shoulders of the user.

Figure 4:
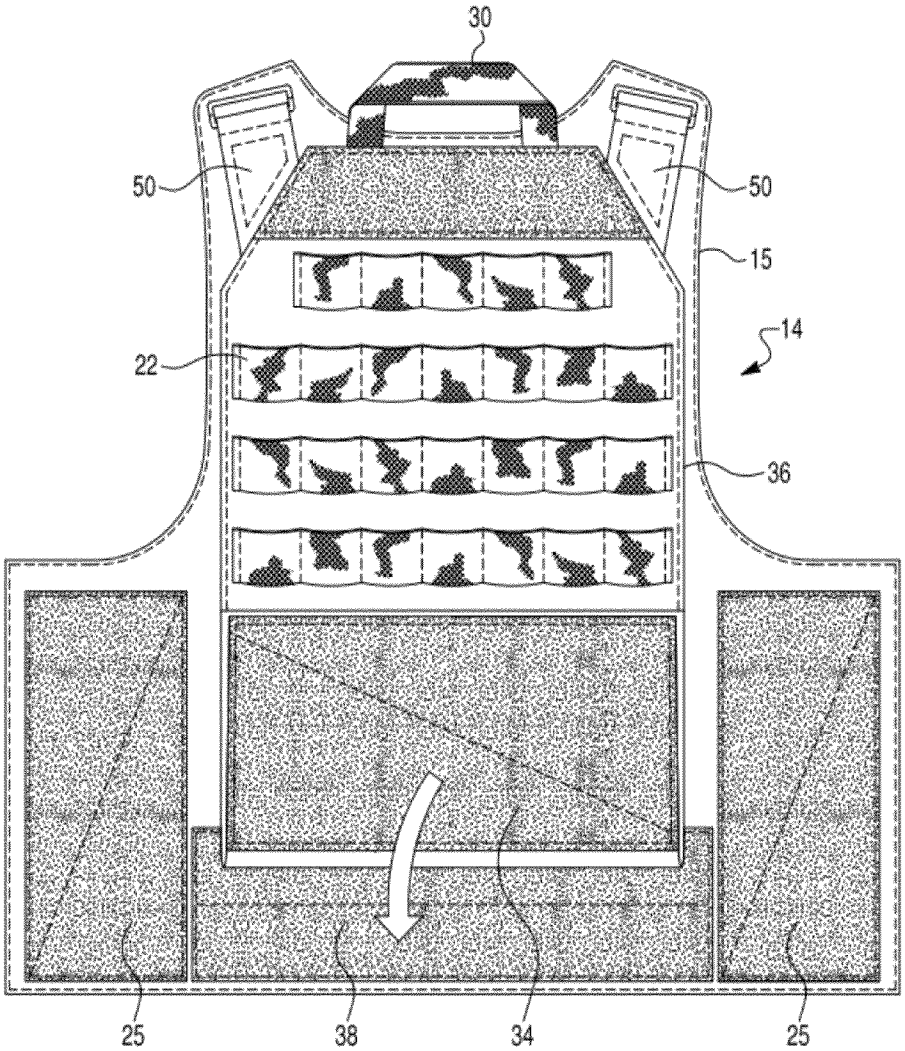
FIG. 4 is an elevation view of the rear piece of a vest according to the present invention.

In FIG. 4, the rear panel 14 is shown from a rearward perspective. The MOLLE system 36 is shown along with MOLLE standards 22. Straps 50 are also shown in position as they proceed in position over the shoulder position of a wearer. The rear panel also includes very securely attached drag handle 30, preferably made of 1 inch tubular nylon webbing, for use in maneuvering and assisting wearers of the vest who may have become incapacitated and unable to move on their own. The rear panel includes a hard armor pocket directly accessed through downwardly opening closure 34. The inside of the closure 34 is likewise lined with "SPECTRA" material (ballistic woven fabric) for contacting the hard armor plate and resisting wear through at the closure 34. The hard armor plate is a standard item that is available in various sizes, curves, and specifications according to the relative projectile resistance required by the user.

Figure 5:
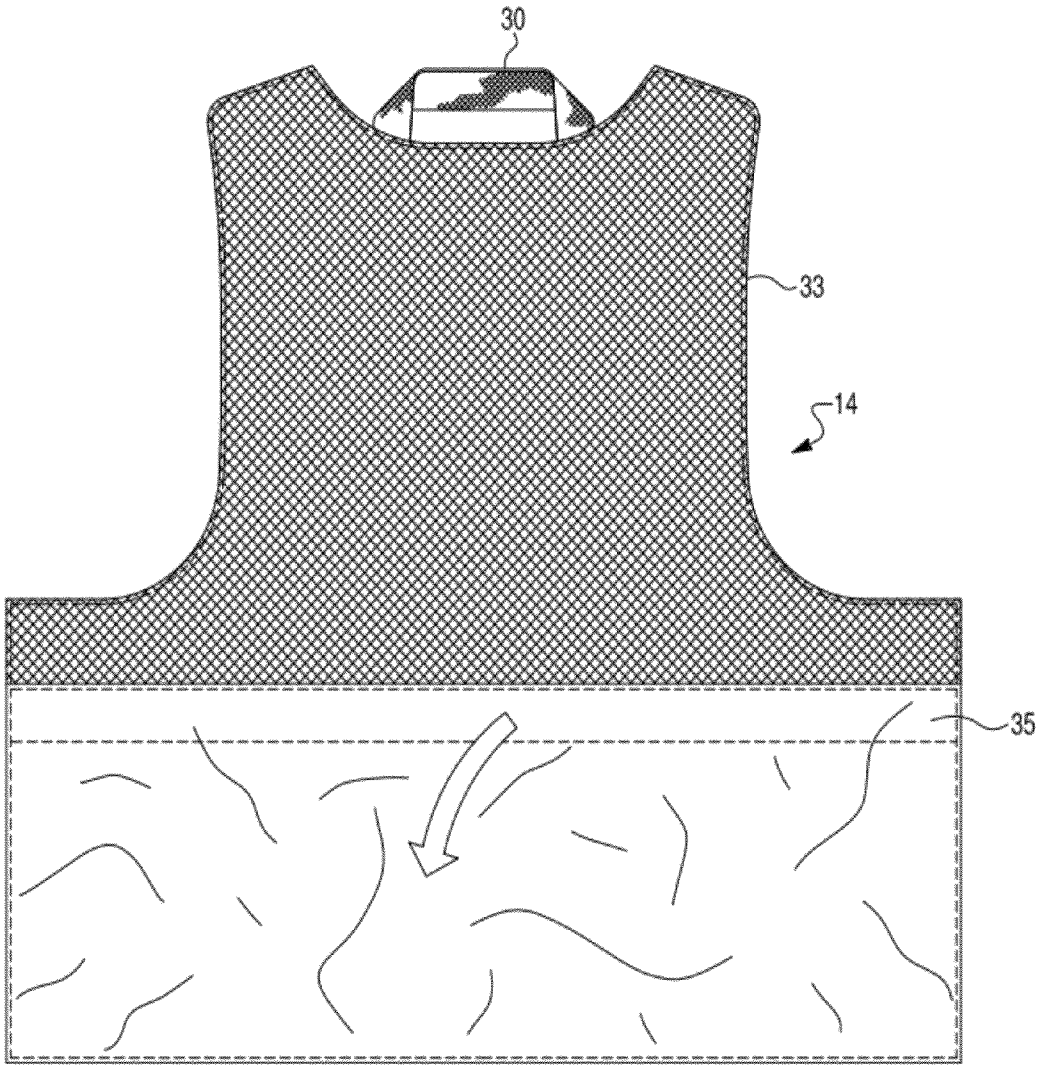
FIG. 5 is a rearward looking view of the inside of the rear piece of the vest in accord with the present invention.

In FIG. 5 the inner side of the back panel 14 is shown. This panel 14 has an inner mesh pocket 33 as does the front panel 12. The full vest panel pocket is accessed through full-width hook and loop closure 35. Similar to the front panel 12, soft armor may be inserted into the pocket. The soft armor inserted here would rest against the wearer through mesh 23 and protect the wearer against direct contact with the hard armor in the outer pocket of the rear panel 14 accessed through closure 34.

Figure 6:
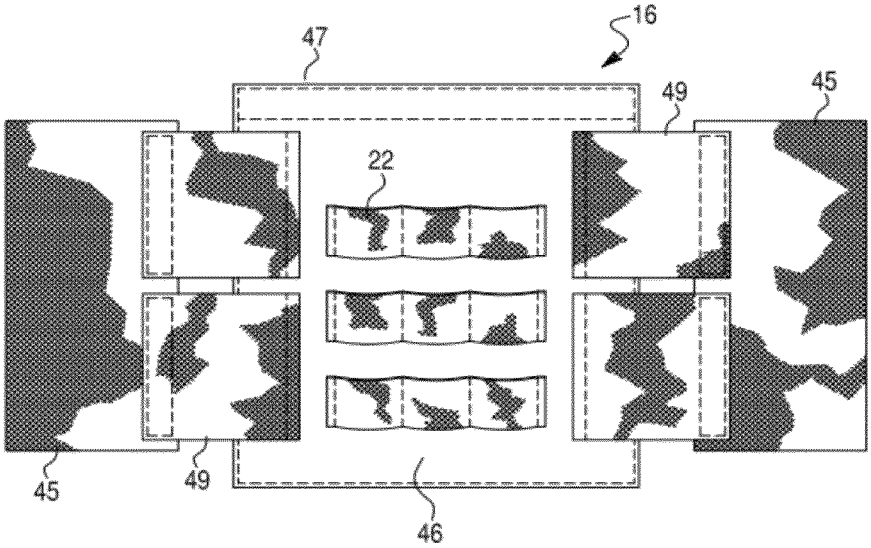
FIG. 6 is an elevation view of a linking side piece of a vest in accord with the present invention.
Figure 7:
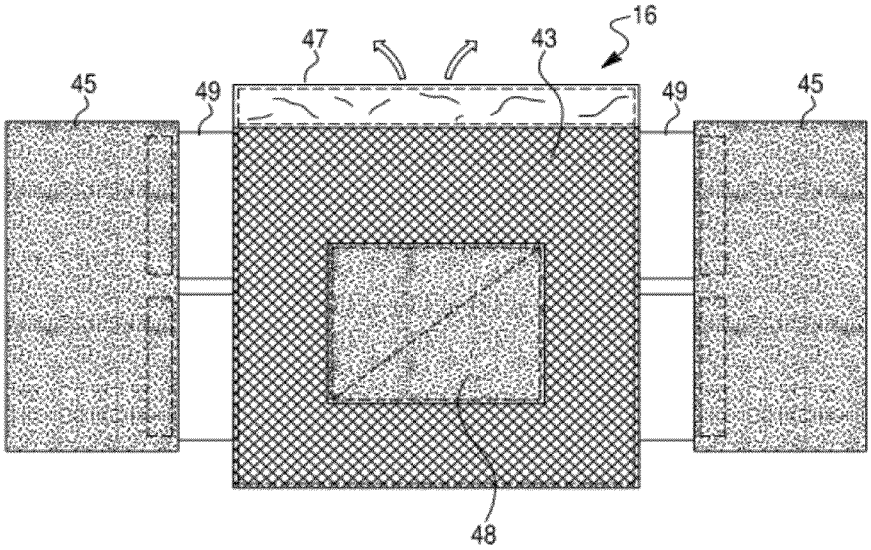
FIG. 7 is an inside outwardly looking view of a linking side piece of a vest in accord with the present invention.

While the respective front 12 and rear 14 panels are related one-to-the-other by shoulders straps 50 to create an over the head clamshell effect, side elements 16, shown in FIGS. 6 and 7, complete the ensemble of the vest 10. The shoulder straps 50 are infinitely adjustable owing to their hoop and loop over lapping relation. These shoulder straps 50 can be attached and released as many times as necessary, and incrementally moved, to accommodate a wide range of user comfort requirements, Likewise, side elements 16 also include hook and loop fastening 45, 48 to overlap and associate the front panel 12 and back panel 14 connecting between the respective hook and loop fabric covered panels 25 associated therewith and shown in the respective drawing figures. In addition, the side elements 16 include molle panels 46 and standards 20. The side elements 16 also have an inner mesh liner 43 pocket for containing a hard/soft armor insert accessed through full width hook and loop closure 47. Side elements 16 also include elastic webbing 49 connecting between the pocket panel 46 and fastening elements 45. The elastic webbing 49 allows for resilient expansion and contraction of the side element(s) 16 in overall attachment length while in place connecting between the respective front and rear panels 12 and 14. This resilience provides for greater wearer comfort and ease of mobility.

Overall, the lightweight construction of the vest herein results in an approximate 50% empty weight savings when corn pared to a prior art armor carrying vest. This construction also provides ready and direct access to the respective front, back, and side element hard armor carrying pockets. The respective inner mesh pockets provide superior breath-ability and easy soft armor insert acceptability. The resilient webbing incorporated into the side elements along with the large surface areas on the front 12 and back 14 panels covered with hook and loop fastening capability allow for a vast range of wearer adjustability. The inner and outer pocket combinations allow for a wearer to "customize/optimize" the armor combinations for a particular mission. A wearer can go with a hard/soft combination, soft only, hard only, soft/soft, etc. according to their specific need and circumstance. Individually inserted armor elements can be accessed and replaced as needed.

The overall design of this vest is consistent with the working and operational use for which it was intended. It is constructed of lightweight and strong material which allows for the use of less material to ensure it has high dependability and strength. Its replaceable portions allow it to be repaired and placed back into service rapidly. This unit has been tested in combat.

While the present invention has been described above in terms of specific embodiments, it is to be understood that the invention is not limited to these disclosed embodiments. Many modifications and other embodiments of the invention will come to mind of those skilled in the art to which this invention pertains, and which are intended to be and are covered by both this disclosure and the appended claims It is indeed intended that the scope of the invention should be determined by proper interpretation and construction of the appended claims and their legal equivalents, as understood by those of skill in the art relying upon the disclosure in this specification and the attached drawings.

The invention claimed is:

1. A vest for carrying armor plates and ballistic panels, comprising:

a front panel having upper and lower portions, and including a $1^{st}$ inner mesh panel over lying a $1^{st}$ intermediate panel that overlies a $1^{st}$ outer panel, said $1^{st}$ inner mesh panel being attached to said $1^{st}$ intermediate panel at a periphery thereof to define a $1^{st}$ inner pocket between said $1^{st}$ mesh and $1^{st}$ intermediate panel, said $1^{st}$ intermediate panel being attached to said $1^{st}$ outer panel around a periphery thereof to form a $1^{st}$ outer pocket between said $1^{st}$ intermediate and $1^{st}$ outer layer, each of said respective inner and outer pockets being accessed through an opening along an edge of said respective $1^{st}$ pockets;

a back panel having upper and lower portions, and including a $2^{nd}$ inner mesh panel overlying a $2^{nd}$ intermediate panel that overlies a $2^{nd}$ outer panel, said $2^{nd}$ inner mesh panel being attached to said $2^{nd}$ intermediate panel at a periphery thereof to define a $2^{nd}$ inner pocket between said $2^{nd}$ inner mesh and $2^{nd}$ intermediate panels, said $2^{nd}$ intermediate panel being attached to said $2^{nd}$ outer panel around a periphery thereof to form a $2^{nd}$ outer pocket between said $2^{nd}$ intermediate and $2^{nd}$ outer layer, each of said respective $2^{nd}$ inner and $2^{nd}$ outer pockets being accessed through an opening along an edge of said respective $2^{nd}$ pockets;

shoulder straps connecting and adjustably relating upper left and right side portions of respective upper portions of said front and back panels one to the other; and, side elements including pocket panels therein, said pocket panels connected to forwardly and rearwardly oriented fastening elements for connecting and adjustably relating lower left and right portions of said front and back panels.

2. A vest as in claim 1, wherein:

said side elements include resilient webbing connecting between said pocket panels and said fastening elements.

3. A vest as in claim 1, wherein:

outwardly exposed surfaces of said front and back panels further comprise hook and loop fabric and said fastening elements of said side elements include complementary hook and loop fabric for attaching to said outwardly exposed surfaces of said front and back panels.

4. A vest as in claim 1, wherein:

said 1 and $2^{nd}$ outer pockets are lined at high wear edge contact areas with ballistic woven fabric to resist wear-through from inserted hard armor plating.

5. A vest as in claim 1, wherein:

said front panel, back panel, and side element exterior surfaces include a modular lightweight load-carrying equipment attachment strap system.

* * * * *